US006213667B1

(12) United States Patent
Isaac

(10) Patent No.: US 6,213,667 B1
(45) Date of Patent: Apr. 10, 2001

(54) SELF CLEANING PAINT BRUSH

(76) Inventor: Raphael Isaac, 17 Nassau Dr., Great Neck, NY (US) 11021

( * ) Notice: Subject to any disclaimer, the term of this patent is extended or adjusted under 35 U.S.C. 154(b) by 0 days.

(21) Appl. No.: 09/547,208

(22) Filed: Apr. 11, 2000

(51) Int. Cl.[7] ..... A46B 11/06
(52) U.S. Cl. ..... 401/289; 401/282
(58) Field of Search ..... 401/289, 282, 401/283; 15/160, 159.1

(56) References Cited

U.S. PATENT DOCUMENTS

| | | | | |
|---|---|---|---|---|
| 352,009 | * | 11/1886 | Seery | 401/289 |
| 1,335,671 | | 3/1920 | Dunn . | |
| 2,227,792 | | 1/1941 | Norton, Jr. . | |
| 2,341,881 | | 2/1944 | Rasch . | |
| 2,591,845 | | 4/1952 | Magoon . | |
| 2,707,293 | * | 5/1955 | Ferrer | 401/289 |
| 2,959,801 | | 11/1960 | Pelham . | |
| 4,673,307 | * | 6/1987 | Prestele et al. | 401/289 |
| 4,676,685 | | 6/1987 | Murphy . | |
| 4,790,679 | | 12/1988 | Murphy . | |
| 4,916,773 | | 4/1990 | McCoy . | |
| 5,398,365 | | 3/1995 | MacKenzie . | |
| 5,483,721 | | 1/1996 | Caldwell . | |

* cited by examiner

*Primary Examiner*—David J. Walczak
(74) *Attorney, Agent, or Firm*—Collard & Roe, P.C.

(57) ABSTRACT

A paint brush that contains a hollow handle that attaches to a water source. A tube within the hollow handle that provides a passage for the water running through the hollow handle. A hollow brush head is attached to the hollow handle, and is comprised of two opposing walls curved at their ends for connecting to each other. A bristle bar containing a plurality of bristles is attached to the hollow head. Within the bristle bar there are orifices through which the water flows. The hollow brush head contains at least one diverting bar disposed within that controls the flow of water through said bristles. Wherein the water source is attached to the hollow handle, and water flows through the tube, through the hollow head, over the diverting bars, through the orifices and through the plurality of bristles for easy cleaning.

19 Claims, 4 Drawing Sheets

SELF CLEANING PAINT BRUSH

BACKGROUND OF THE INVENTION

Field of the Invention

This invention relates to a self cleaning paint brush. More specifically, the invention relates to a paint brush that has a hollow handle for attaching to a water source, and a hollow head that contains water diverting bars therein to control the flow of water through the bristles.

SUMMARY OF THE INVENTION

When cleaning dirty paint brushes they are usually placed inside a cup or tray of water to soak, or held under a faucet. This method is not desirable since the brush is not thoroughly cleaned, and the bristles tend to get bent and therefore, the brush is discarded.

This invention alleviates these problems by providing an easy to clean paint brush. This paint brush consists of a hollow handle that contains a tube that extends throughout to provide a passage for water. A water source is connected to the first end of the paint brush. At the second end of the paint brush, a hollow brush head is attached. This hollow brush head contains at least one diverting bar which controls the flow of water. In addition, a bristle bar or bristle plate containing a plurality of orifices is attached to the hollow head. A plurality of bristles are attached to the bristle bar so that they surround the orifices. These bristles can be fixed to the bristle bar as known in the art either individually or in groups using an adhesive. Therefore, the water flowing through the orifices have contact with all the bristles. The water source is attached to the first end of the hollow handle, and the water flows through the tube, through the hollow head, through the orifices and over the bristles for easy cleaning.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
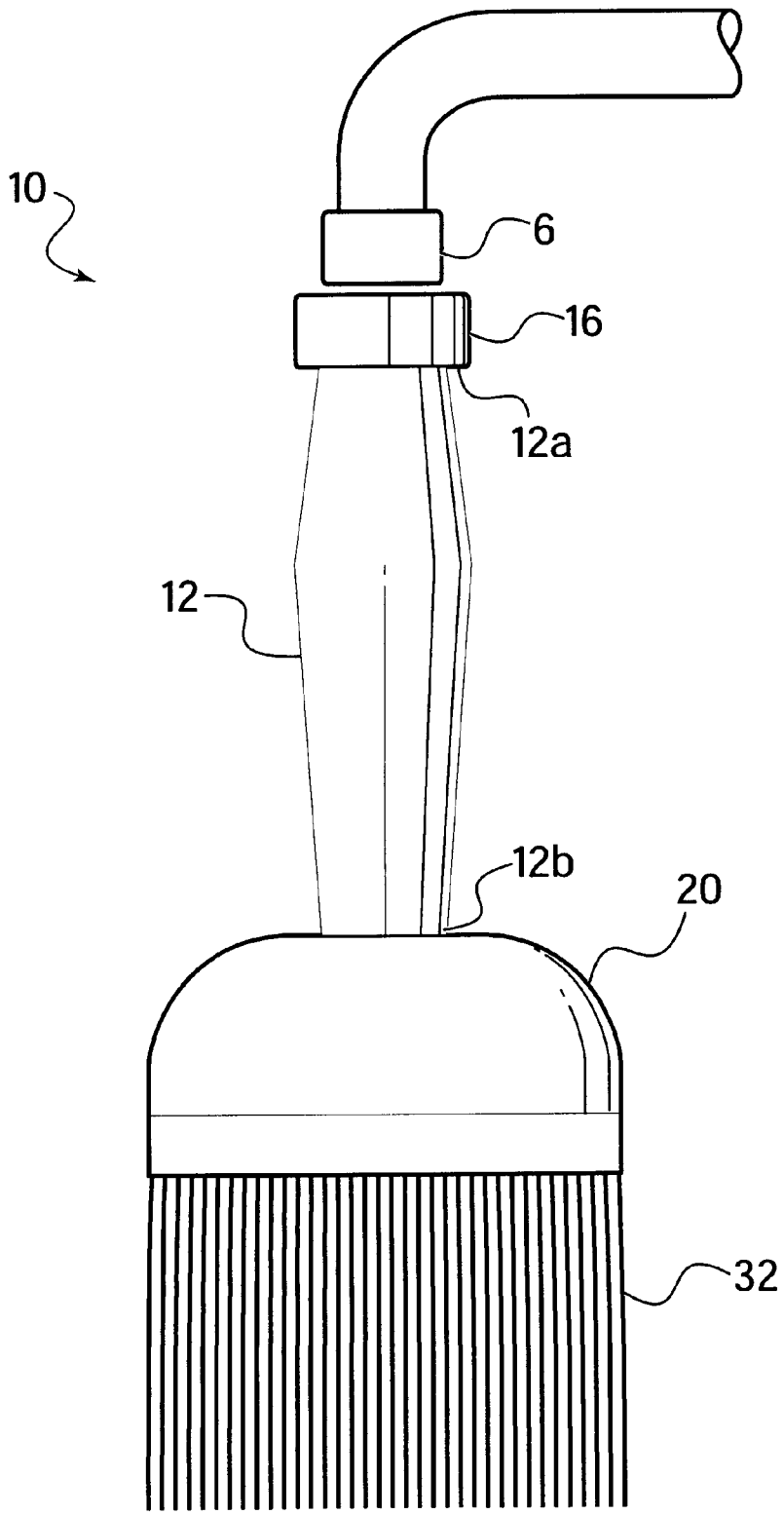
FIG. 1 shows a side view of the paint brush according to the invention.

Referring now in detail to the drawings and, in particular FIG. 1 there is shown a paint brush 10 with a hollow handle

12 having a first end 12*a* and a second end 12*b*. A water source connector 16 is attached to first end 12*a*, and a hollow brush head 20 is connected to second end 12*b*. Water source 6 attaches to water source connector 16 for cleaning bristles 32. Water source connector 16 can be a threaded section that screws onto a water hose or it can snap onto a faucet.

Figure 2:
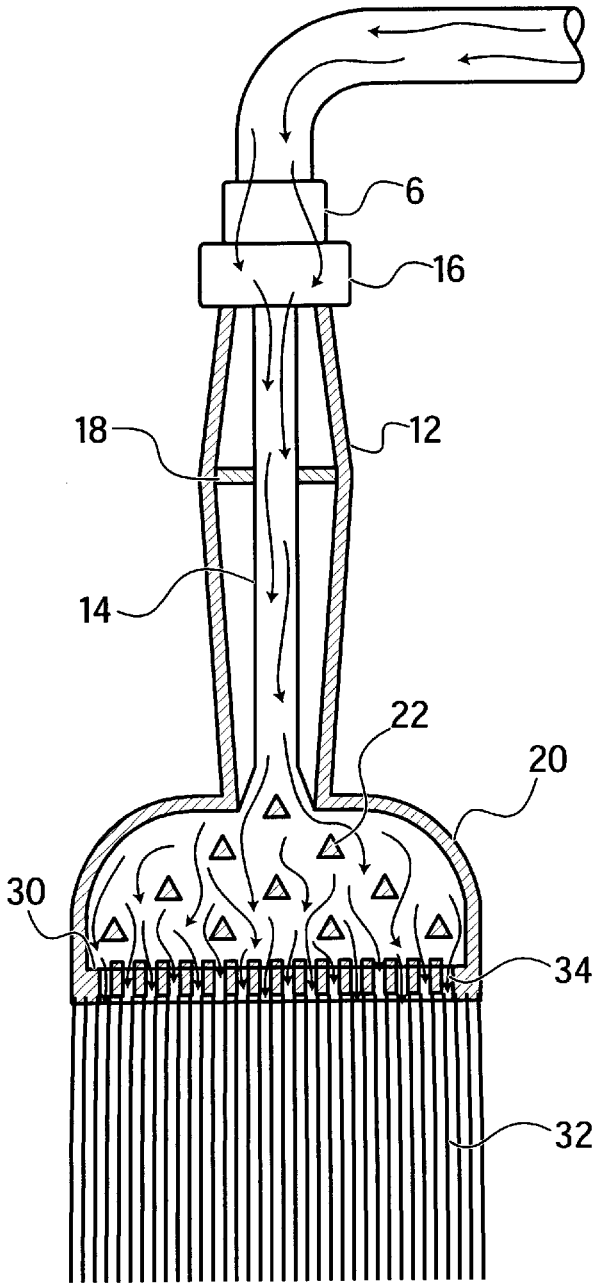
FIG. 2 shows a cut away view of the inside of the paint brush shown in FIG. 1.
Figure 3:
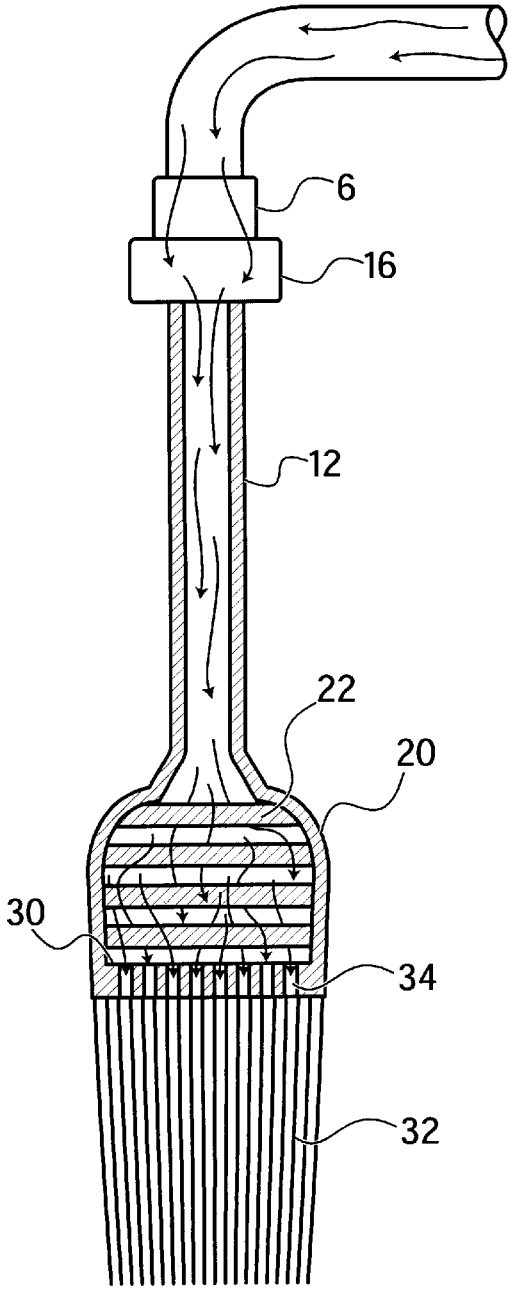
FIG. 3 shows a cross sectional view of the paint brush rotated 90° from FIG. 2.
Figure 5:
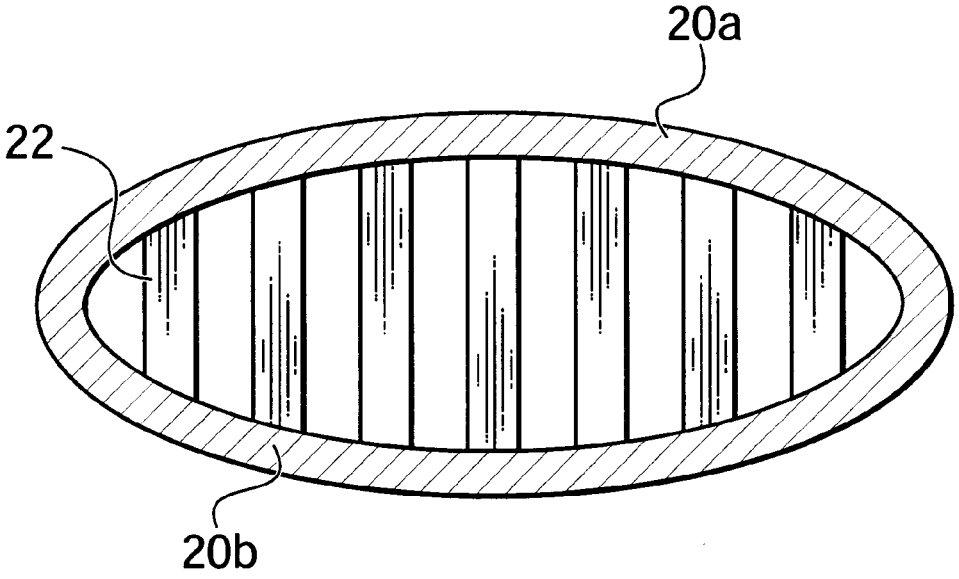
FIG. 5 shows a view of a second embodiment bars looking down into the head of the paint brush.

FIGS. 2 and 3 show the inside of paint brush 10. FIG. 3 is a view of FIG. 2 rotated 90 degrees. Water source 6 connects to water source connector 16 and water flows through tube 14. Tube 14 extends throughout hollow handle 12, and is preferably made of plastic so that the weight of paint brush 10 is minimal. Support bars 18 stabilize tube 14 within hollow handle 12. Support bars 18 prevent tube 14 from moving around inside hollow handle 12 during use. Water flowing through tube 14 enters hollow head 20. Inside hollow head 20 are diverting bars 22 which control the flow of the water. Diverting bars 22 preferably have a triangular cross section. This shape aids in evenly directing the water flow down to bristle bar 30. In a preferred embodiment, there are ten diverting bars that are aligned in rows creating a pyramid shape. Four diverting bars are in the first row, three in the second, two in the third, and one in the top row. Diverting bars 22 extend across the inside of hollow brush head 20, as shown in FIGS. 3 and 5. When the water reaches bristle bar 30 it flows through orifices 34 which are evenly spaced throughout bristle bar 30. Orifices 34 are evenly spaced about bristle bar 30, this arrangement provides the most thorough cleaning of bristles 32.

Figure 4:
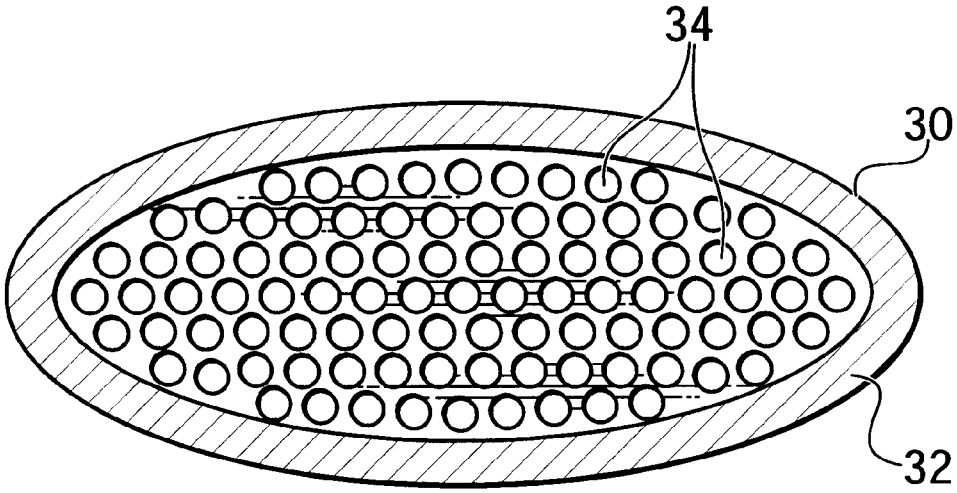
FIG. 4 shows the orifices in the bristle bar of the paint brush.

FIG. 4 shows a view of orifices 34 looking down into bristle bar 30 through bristles 32. Orifices 34 are preferably round in shape and allow the water to flow evenly over each bristle 32, even the inner bristles. These bristles can be adhered to orifices 34 either individually or in groups using an adhesive.

FIG. 5 shows a view of diverting bars 22 looking down into hollow brush head 20. Hollow brush head 20 is comprised of two opposing walls 20*a* and 20*b* which are curved at their ends for connecting to each other. Diverting bars 22 are transeverly disposed between walls 20*a* and 20*b*. The first two rows of diverting bars 22 are seen from this view. The pyramid shape provides for an even flow of water throughout the entire brush head since the water cascades over diverting bars 22 to completely reach the entire surface area of bristle bar 30.

When the paint brush needs cleaning, the handle is attached to a water source, such as a garden hose or sink faucet by screwing or snapping on to the source. Next, water flows through a tube into the hollow brush head. The diverting bars inside the brush head control the flow of water so that it evenly flows through the orifices in the bristle bar. As water flows through the orifices it glides through and around the bristles for a thorough cleaning. It is difficult to thoroughly clean the inside bristles of a paint brush. Having orifices disposed throughout the bristle bar allows the water to reach all the bristles, even the inside bristles.

Figure 6:
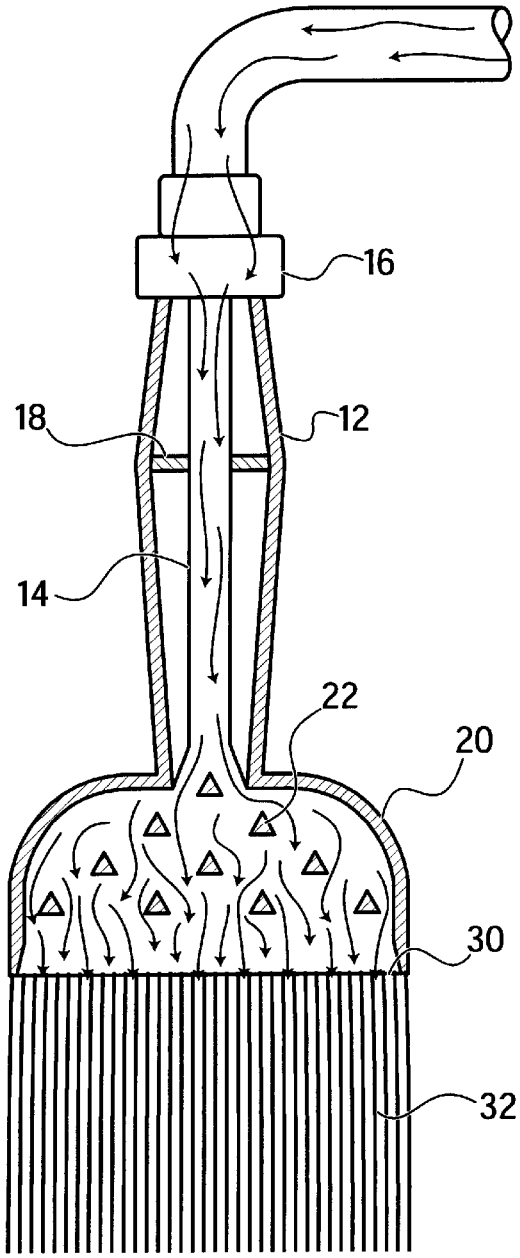
FIG. 6 shows a side view of another embodiment of the paint brush according to the invention.
Figure 7:
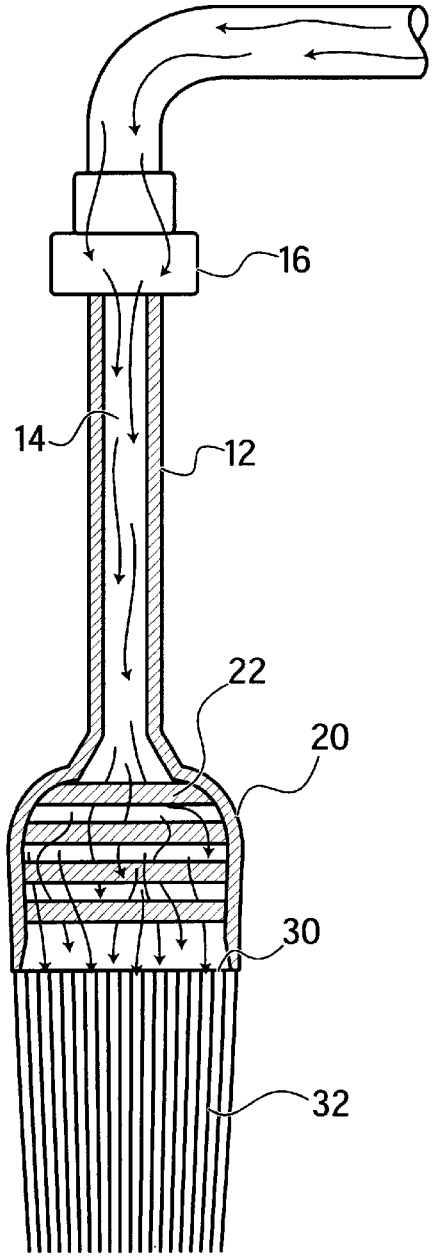
FIG. 7 shows a cross sectional view of the paint brush rotated 90° from FIG. 6.

FIGS. 6 and 7 show another embodiment of the invention which includes water source connector 16 and tube 14 extending throughout hollow handle 12. Support bars 18 stabilize tube 14 within hollow handle 12. Water flowing through tube 14 enters hollow head 20. Inside hollow head 20 are diverting bars 22 which control the flow of the water. When the water reaches bristle bar 30 it flows directly through bristle bar 30 onto bristles 32. This arrangement provides another method of effectively cleaning bristles 32. With this second embodiment, bristle bar 30 as shown in FIG. 6, is thinner than bristle bar 30 shown in FIG. 2.

Accordingly, while only two embodiments of the present invention have been shown and described, it is obvious that many changes and modifications may be made thereunto without departing from the spirit and scope of the invention.

What is claimed is:

1. A paint brush comprising:

a) a hollow handle comprised of:

i) a first end for attaching to a water source;

ii) a second end; and iii) a tube providing a passage for water running through said hollow handle from said first end to said second end;

b) a hollow brush head attached to said second end of said hollow handle, and is comprised of two opposing walls curved at their ends for connecting to each other;

c) a bristle bar containing a plurality of extending bristles, said bristle bar is attached to said hollow head;

d) a plurality of orifices disposed in said bristle bar; and e) at least one diverting bar disposed within a hollow section of said hollow brush head and extending substantially perpendicular to the direction in which said bristles extend, to control the flow of water through said bristles;

wherein a water source is attached to said first end of said hollow handle, water flows through said tube, through said hollow head, over said at least one diverting bar, through said plurality of orifices and through said plurality of bristles for easy cleaning.

2. The paint brush according to claim 1, wherein said first end comprises a connector for attaching to a water source.

3. The paint brush according to claim 1, wherein said tube is plastic.

4. The paint brush according to claim 1, wherein said handle contains at least one support bar for supporting said tube.

5. The paint brush according to claim 1, wherein said plurality of orifices are evenly spaced along said bristle bar to allow the water to uniformly flow over said plurality of bristles.

6. The paint brush according to claim 1, wherein said hollow head further comprises six additional diverting bars.

7. The paint brush according to claim 6, wherein said at least one diverting bar and said six additional diverting bars have triangular cross sections.

8. The paint brush according to claim 7, wherein said at least one diverting bar and said six additional diverting bars are disposed transversely between said two opposing walls of said hollow brush head.

9. The paint brush according to claim 8, wherein said at least one diverting bar and said six additional diverting bars are arranged in a pyramid shape.

10. A paint brush comprising:

a) a hollow handle comprised of:

i) a first end for attaching to a water source;

ii) a second end; and iii) a tube providing a passage for water running through said hollow handle from said first end to said second end;

b) a hollow brush head attached to said second end of said hollow handle, and is comprised of two opposing walls curved at their ends for connecting to each other;

c) a bristle bar containing a plurality of extending bristles, said bristle bar is attached to said hollow head; and d) at least one diverting bar disposed within a hollow section of said hollow brush head and extending substantially perpendicular to the direction in which said bristles extend, to control the flow of water through said bristles;

wherein a water source is attached to said first end of said hollow handle, water flows through said tube, through said hollow head, over said at least one diverting bar, and through said plurality of bristles for easy cleaning.

11. The paint brush according to claim 10, wherein said first end comprises a connector for attaching to a water source.

12. The paint brush according to claim 10, wherein said tube is plastic.

13. The paint brush according to claim 10, wherein said handle contains at least one support bar for supporting said tube.

14. The paint brush according to claim 10, wherein said hollow head further comprises six additional diverting bars.

15. The paint brush according to claim 14, wherein said at least one diverting bar and said six additional diverting bars have triangular cross sections.

16. The paint brush according to claim 15, wherein said at least one diverting bar and said six additional diverting bars are disposed transversely between said two opposing walls of said hollow brush head.

17. The paint brush according to claim 16, wherein said at least one diverting bar and said six additional diverting bars are arranged in a pyramid shape.

18. A paint brush comprising:

a) a hollow handle comprised of:

I) a first end for attaching to a water source;

ii) a second end; and iii) a tube providing a passage for the water running through said hollow handle from said first end to said second end;

b) a hollow brush head attached to said second end of said hollow handle, and is comprised of two opposing walls curved at their ends for connecting to each other;

c) a bristle bar containing a plurality of bristles, said bristle bar is attached to said hollow head;

d) a plurality of orifices disposed in said bristle bar; and e) at least one diverting bar disposed within said hollow brush head wherein said at least one diverting bar had a triangular cross-section and said at least one diverting bar is designed to control the flow of water through said bristles;

wherein when a water source it attached to said first end of said hollow handle, water flows through said tube, through said hollow head, over said at least one diverting bar, through said plurality of orifices and through said plurality of bristles for easy cleaning.

19. The paint brush according to claim 18, wherein said paint brush contains at least ten diverting bars that are arranged in a triangular shaped pattern within said housing.

* * * * *